US006527255B2

(12) United States Patent
O'Berry et al.

(10) Patent No.: US 6,527,255 B2
(45) Date of Patent: Mar. 4, 2003

(54) FENCE POST PROTECTOR

(76) Inventors: Jon Louis O'Berry, 664 Exmoor Ct., Crystal Lake, IL (US) 60014; Robert D. Plummer, Jr., 2507 Tamarck La., Union, MO (US) 63084

( * ) Notice: Subject to any disclaimer, the term of this patent is extended or adjusted under 35 U.S.C. 154(b) by 0 days.

(21) Appl. No.: 09/861,908

(22) Filed: May 21, 2001

(65) Prior Publication Data

US 2002/0171073 A1 Nov. 21, 2002

(51) Int. Cl.[7] ..... E04H 17/00
(52) U.S. Cl. ..... 256/1; 256/32
(58) Field of Search ..... 256/1, 19, 32, 256/20

(56) References Cited

U.S. PATENT DOCUMENTS

| | | | | |
|---|---|---|---|---|
| 2,782,561 A | | 2/1957 | Smith | |
| 3,704,004 A | * | 11/1972 | Carter, Jr. | 256/1 |
| 3,806,096 A | * | 4/1974 | Eccleston et al. | 256/32 |
| 3,991,980 A | * | 11/1976 | Blackburn | 256/1 X |
| 4,431,166 A | * | 2/1984 | Marshall | 256/1 |
| 4,478,391 A | * | 10/1984 | Kovach | 256/1 |
| 4,497,472 A | * | 2/1985 | Johnson | 256/32 |
| 4,548,388 A | * | 10/1985 | Cobler | 256/32 |
| 4,690,382 A | * | 9/1987 | Koperdak | 256/1 |
| RE33,037 E | | 8/1989 | Kauffman et al. | |
| 4,858,378 A | | 8/1989 | Helmy | |
| 4,903,947 A | * | 2/1990 | Groves | 256/1 X |
| 4,934,093 A | | 6/1990 | Yanna | |
| 4,964,619 A | | 10/1990 | Glidden, Jr. | |
| 5,039,065 A | | 8/1991 | Denton | |
| 5,285,594 A | | 2/1994 | Penny | |
| 5,452,541 A | | 9/1995 | DeMaio | |
| 5,586,753 A | | 12/1996 | Michiaels | |
| 5,685,522 A | | 11/1997 | Randolph, Jr. | |
| 5,878,528 A | * | 3/1999 | Pattyn | 47/25 |
| 6,070,859 A | * | 6/2000 | Damon et al. | 256/1 |
| 6,257,557 B1 | * | 7/2001 | Anderson et al. | 256/1 |
| 6,276,869 B1 | * | 8/2001 | Yakushinji | 256/1 X |

FOREIGN PATENT DOCUMENTS

| | | |
|---|---|---|
| FR | 2705719 | * 12/1994 |

* cited by examiner

*Primary Examiner*—Lynne H. Browne
*Assistant Examiner*—David E. Bochna
(74) *Attorney, Agent, or Firm*—Mathew R. P. Perrone, Jr.

(57) ABSTRACT

A fence post protector has a first substantially flat piece, which combines with a second substantially flat piece in order to form an opening therebetween. The opening is adapted to receive a fence post therein, and at least reduce vegetation growth therearound, while at the same time, reducing natural and man made damage thereto.

21 Claims, 4 Drawing Sheets

FENCE POST PROTECTOR

This invention relates to a fence post protector and more particularly to a fence post protector which mounts at the base of the fence post.

BACKGROUND OF THE INVENTION

A fence has both utility and decorative capabilities. That is to say, a fence can offer either a protective or utilitarian purpose, or provide an appropriate aesthetic appearance. In the best of circumstances, a fence may provide both protection and an appropriate aesthetic appearance.

As protective manner, a fence may keep domestic animals contained. It may also serve as a defensive mechanism against wild animals, whether to contain the wild animals in a specific place, or to keep them out.

However, a major problem with a fence is keeping the base of the fence post clear of vegetation. More particularly, it is desirable to avoid the growth of the vegetation around and at the base of the fence post. Such vegetation is difficult to cut or otherwise remove from the base of the fence post. Yet, this vegetation must be trimmed or otherwise removed, in order to have an aesthetically pleasing appearance with the fence.

Even the power trimming devices used in lawn care do not overcome all of the difficulties of trimming vegetation around the base of the fence post. Power blades break on a fence post. Line trimmers cannot always get good access to cut the grass or other vegetation around the fence post.

Such power trimmers also strike the base of the fence posts and cause damage thereto. If the damage becomes severe, the fence post must be replaced. Such replacement is expensive and time-consuming. Yet there is no satisfactory method to replace the power trimming devices.

Furthermore, water may gather or accumulate around the base the fence post. Such a concentration of water can cause damage that the fence post at the base, just as the power trimmer does. Clearly, the water can also damage the foundation into which the fence posts set. Thus, it is desirable to prevent water from gathering at the base of the fence post.

Additionally, trimming around the fence posts is a two-sided operation. One must trim first along one side of the fence, such as trimming outside of the fence and the post. Then the procedure must be repeated on the other side or inside of the fence and the post. Such difficulties are a major problem.

SUMMARY OF THE INVENTION

Among the many objectives of this invention is the provision of an article adapted to fit around a fence post at ground level.

A further objective of this invention is to provide an article adapted to cover an area around the base of a fence post.

A still further objective of this invention is to provide an article adapted to prevent growth of vegetation around the base of a fence post.

These and other objectives of the invention (which other objectives become clear by consideration of the specification, claims and drawings as a whole) are met by providing a fence post protector having a first substantially flat piece, and a second substantially flat piece, being combinable in order to form an opening therebetween, with the opening adapted to receive a fence post and a releasable fastener oppositely disposed from movably joined position.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

A fence post protector includes a first piece attached to a second piece. Between the first piece and the second piece is formed an aperture, which receives the fence post. Aperture, receiver or opening are sometimes used interchangeably herein. As the opening is formed by the two pieces of the fence post protector, the fence post protector fits around the fence post, the protector prohibits the growth of vegetation close to the fence post and avoids the problems, caused the vegetation which customarily grows therearound. In this fashion, the work of trimming around the fence post is eliminated or at least greatly reduced.

Because the fence post protector has two pieces, it may be used or installed around an existing fence. Such a procedure provides a great advantage for the fence post protector. Additionally, the fence post protector may be used with a new fence in either two-piece fashion, or a one piece fashion.

If the fence post protector is one-piece, it must be installed around a fence post either prior to positioning in the ground or prior to attaching the fence to the post. When the post is in the ground, the fence post protector is placed over the post. Then the protector, must slide over the post and be positioned adjacent to the ground.

The fence post protector, by forming a tight seal around the base of the fence post, substantially eliminates the needed to trim vegetation growth around the post. The fence post protector deprives the vegetation of sunlight, thereby preventing its growth. Additionally, the fence post protector prevents rain and other moisture from settling around the fence post base. Such moisture at the base of the posts damages both the post and its foundation.

The fence post protector also reduces or eliminates the manual labor needed to trim around the fence post base. The fence post protector makes it possible to use a lawn mower around the base of the post and avoid a manual trimming.

From a top plan view of the fence post protector, the outer perimeter is preferably a generally elliptical shape. The elliptical shape has both desirable decorative and utilitarian functions. However the outer perimeter may be circular, square, rectangular, polygonal, irregular, or any other suitable shape.

Also from a top plan view the fence post protector has a more limited shape, because it must fit tightly around the base of the fence post. Such a tight fit is required in order to minimize vegetation growth therearound.

Due to the required tight fit, a desired material is a flexible, durable plastic. Such stable flexible plastics are well known in the art. The flexibility provides for the tight fit. A desired material also has resistant to damage from exposure to sunlight.

A preferred fastener is a stake adapted to fit through apertures in the fence post protector. Even more preferred is a stake with a holding mechanism or ridges designed to hold the stake, and hence the fence post protector in position.

Figure 1:
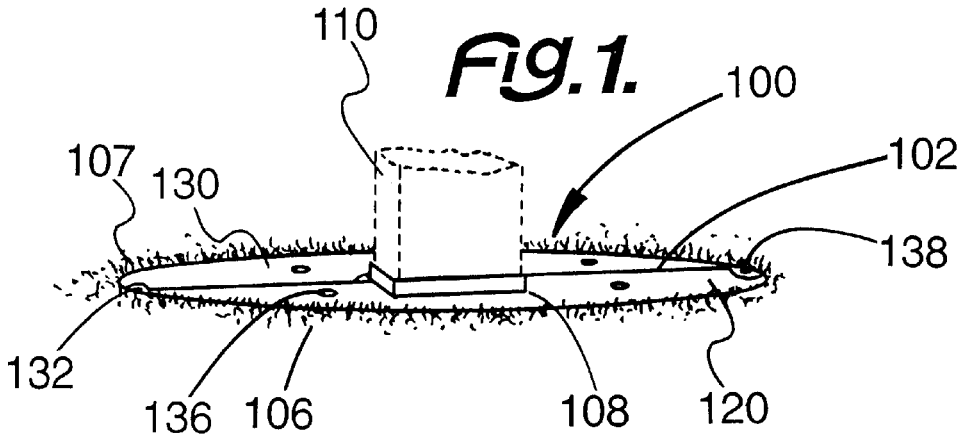
FIG. 1 depicts a top perspective view of a fence post protector 100 of this invention in use with a fence post 110.
Figure 2:
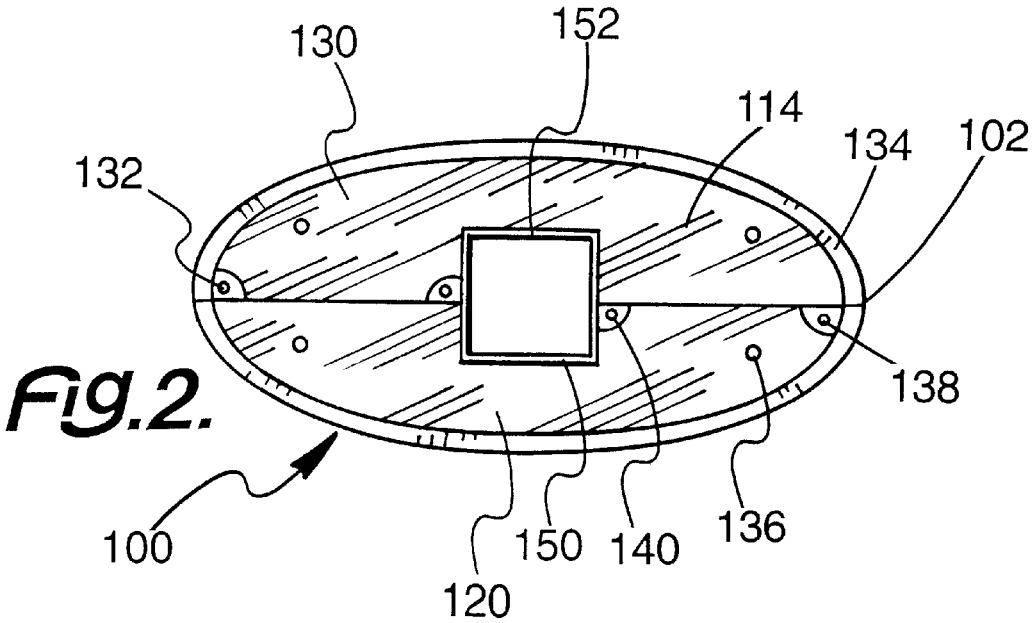
FIG. 2 depicts a top plan view of the hinged fence post protector 100 of this invention in closed position 102.
Figure 3:
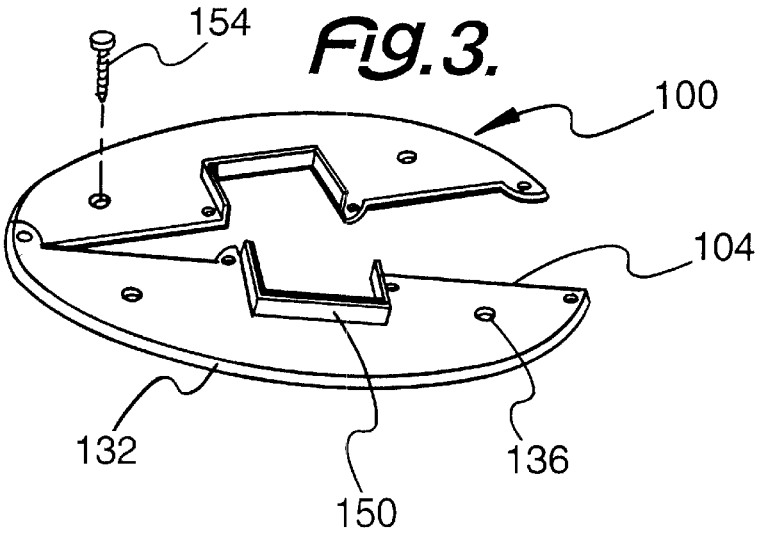
FIG. 3 depicts a top plan view of the hinged fence post protector 100 in open position 104.

Referring now to FIG. 1, hinged fence post protector 100 is situated around the base 108 of a fence post 110 on the ground 106. The hinged fence post protector 100 includes a hinged first piece 120 and a hinged second piece 130. At one end thereof, hinged first piece 120 and hinged second piece 130 are relatively movable and secured together with a hinge 132.

Hinge 132 may be snapped together as the fence post protector 100 is placed in position around the fence post 110. The hinged first piece 120 and hinged second piece 130 include an outer apron 134.

Oppositely disposed from a hinge 132 is an outer locking clasp 138. With outer locking clasp 138 securing hinged first piece 120 to hinged second piece 130 in an adjoining relationship due to the combination with hinge 132, hinged fence post protector 100 becomes extremely useful.

Inner locking clasps 140 are optional and may be positioned on the hinged fence post protector 100 and adjacent to fence post 110. These inner locking clasps 140 reinforce the joinder of hinged first piece 120 to hinged second piece 130. Both inner locking clasps 140 and outer locking clasp 138 may be the same or different, and be any suitable fastener. The preferred fastener is a snap fastener.

Also if desired, a raised sleeve 150 may be centrally located in the hinged fence post protector 100 around fence post receiver 152. Raised sleeve 150 provides for extra protection against the vegetation growing around fence post 110. Fence post receiver 152 may have a shape adapted to a circumference of fence post 110. Inner locking clasps 140, if present, are adjacent to fence post receiver 152.

Adding FIG. 2, FIG. 3, FIG. 4, and FIG. 5 to the consideration, if desired, the optional anchor post 136 receives, therethrough, a fastener 154, which in turn secures hinged fence post protector 100 to the ground 106. Clearly, fastener 154 may act without anchor post 136. In this fashion, vegetation is prevented from growing at the base of the fence post 102. Thus, trimming around the fence post 110 becomes, at best, unnecessary or, at worst, greatly reduced.

Figure 4:
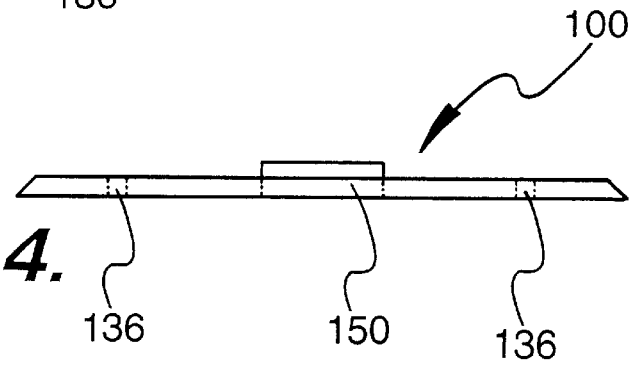
FIG. 4 depicts a side view of a fence post protector 100.
Figure 5:
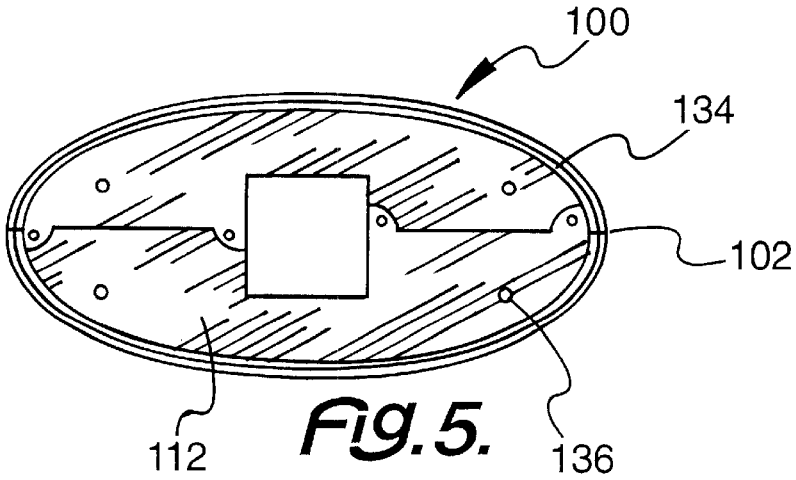
FIG. 5 depicts a bottom plan view of the hinged fence post protector 100 in closed position 102.

While FIG. 4 depicts the top 114 of hinged fence post protector 100 and FIG. 5 depicts the bottom 112 of hinged fence post protector 100, the structure of anchor post 136 and raised sleeve 150 thus becomes clear. Anchor post 136 helps to securely position hinged fence post protector 100 on the ground 106. Raised sleeve 150 adds to the protection of fence post 110, from the growth of vegetation therearound.

Figure 6:
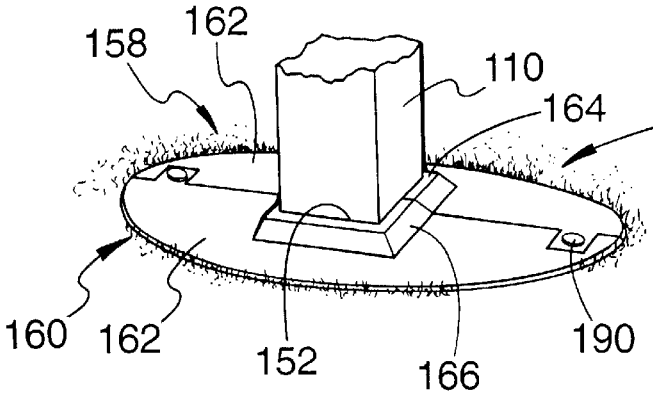
FIG. 6 depicts a perspective application view 158 of two piece fence post protector 160 of this invention.
Figure 7:
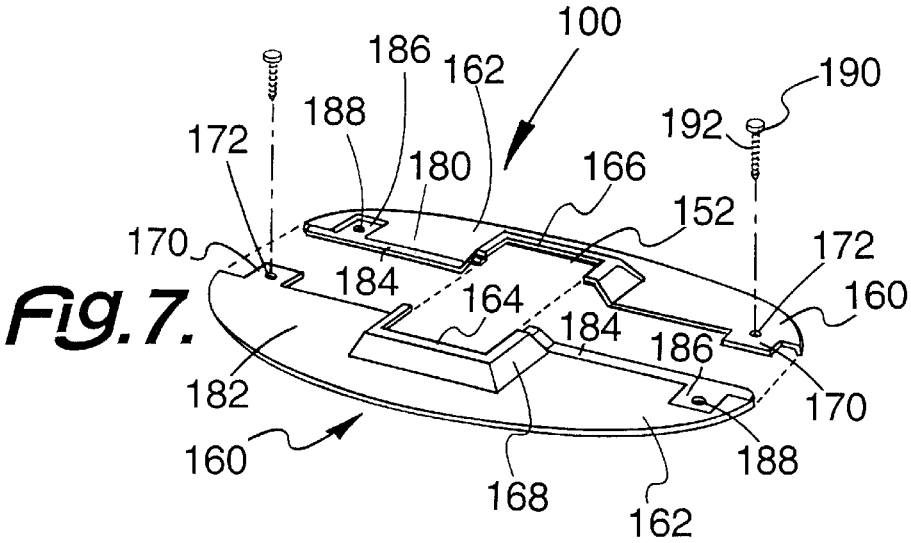
FIG. 7 depicts an exploded perspective view of two piece fence post protector 160.
Figure 8:
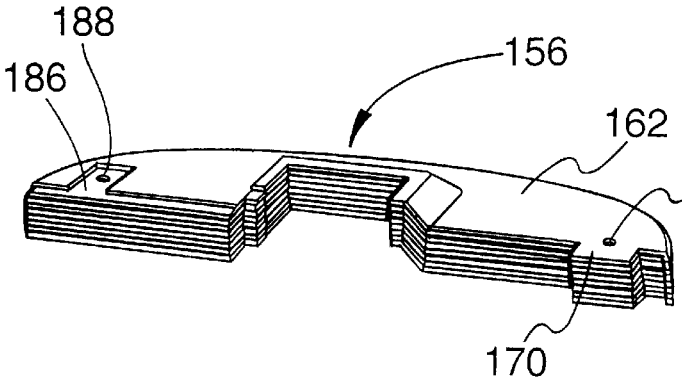
FIG. 8 depicts a perspective, stacked view 156 of shaped piece 162 of this invention.

Referring now to FIG. 6, FIG. 7, and FIG. 8, a much more preferred version than hinged fence post protector 100 in the form of two-piece fence post protector 160 is depicted. Two-piece fence post protector 160 is formed from two of shaped piece 162. Each shaped piece 162 is nestable with and substantially symmetrical to a second shaped piece 162. When it is desired to form two-piece fence post protector 160, two of shaped piece 162 may be placed side-by-side, and then one of shaped piece 162 is rotated 180 degrees so that fence post receiver 152 is formed therebetween.

Shaped piece 162 generally depicts one-half of an ellipse. A central portion thereof includes raised lip 164 having a beveled sleeve in a half fence post shape 166, which substantially covers about one-half of fence post 110. Thus, when one shaped piece 162 is placed adjacent to a second shaped piece 162 to fence post receiver 152 is formed therebetween.

Around the edge of shaped piece 162 is a downward lip 168. On one side of shaped piece 162 is fastening flange 170. Within fastening flange 170 is an upper screw aperture 172. On shaped piece 162 and oppositely disposed from fastening flange 170 is lower flange 180. Lower flange 180 forms a planar piece parallel to the main plane 182 of shaped piece 162, with an appropriate plane lip 184 therebetween.

Extending into main plane 182 is flange receiver 186. Flange receiver 186 may receive fastening flange 170. Within flange receiver 186 is a lower screw aperture 188. As two of one shaped piece 162 are placed adjacent to each other with a fence post receiver 152 therebetween, the upper screw aperture 188 and lower screw aperture 172 line up. A threaded or ridged locking pin 190 is placed through both apertures in the ground 106 around the base 108 of fence post 110.

With the lower screw aperture 172 on a second of two-piece fence protector 160 fitting with the upper screw aperture 188 on a first of two-piece fence protector 160, two piece fence protector 160 works well. As the apertures are aligned, a preferably plastic threaded screw 190 is forced therethrough and then into the ground 106. The plastic screw 190 provides a holding mechanism for the hinged fence post protector 100, and greatly simplified the installation thereof.

Plastic screw 190 has ridges 192 thereon. Ridges 192 support screw 190 in the apertures, and make it difficult to remove plastic screw 190 therefrom. Also, ridges 192 add to a gripping function in the ground 106. Thus, screw 190 secures both of two shaped piece 162, on the ground 106, while at the same time holding two-piece fence post protector 160 in a proper position.

Hinged fence post protector 100 or two-piece fence post protector 160 may be made of any suitable material. The preferred material is opaque, in order to minimize vegetation growth around fence post 110. Fence post receiver 152 may be preformed therein, or cut from hinged fence protector 100, or two piece protector 160, as desired. The most preferred material is opaque and stabilized against ultraviolet degradation. Any durable plastic material with these qualities is operable. Preferably, the plastic is colored green.

Figure 9:
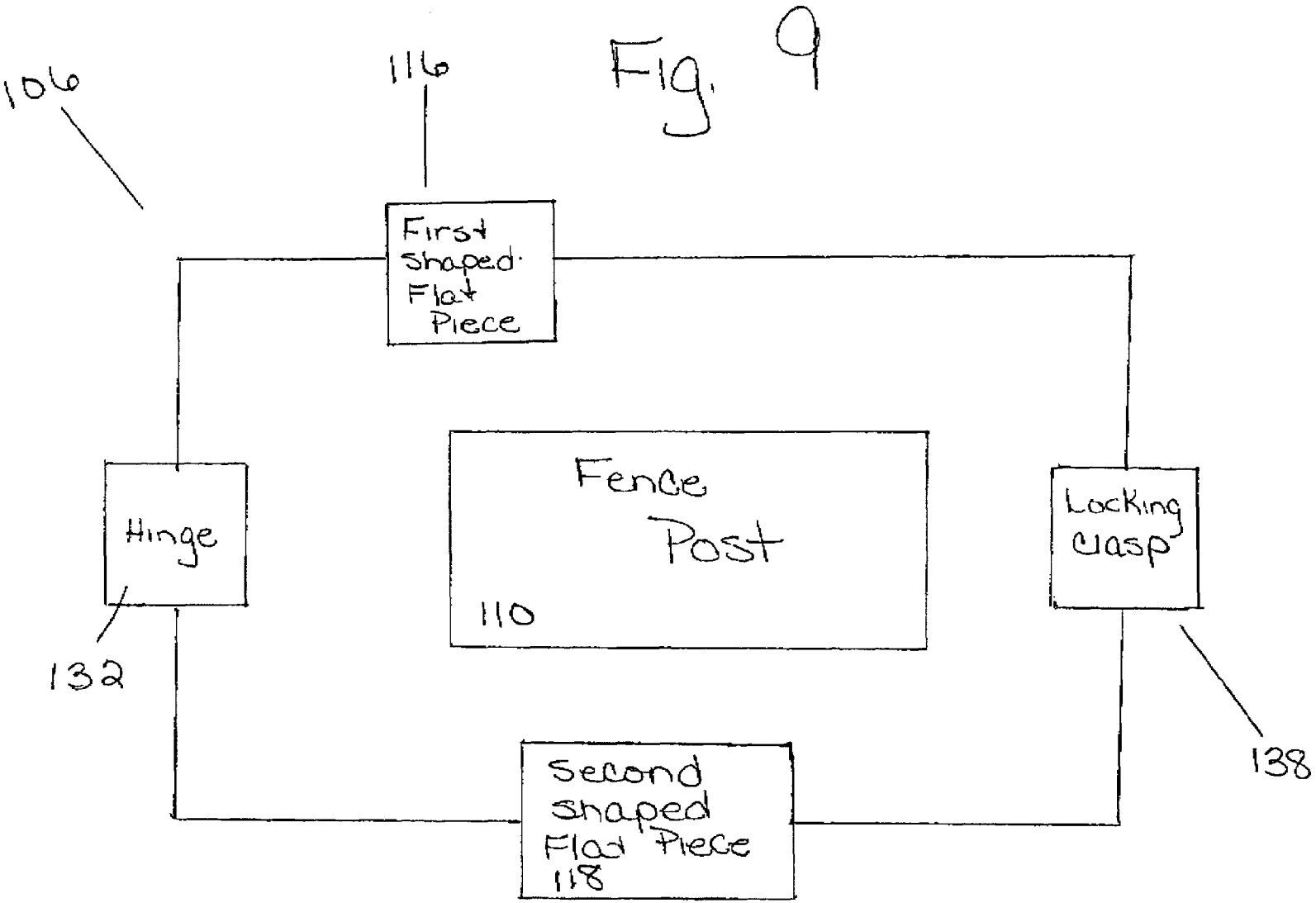
FIG. 9 depicts a block diagram of a fence post protector 100 of this invention in use with a fence post 110.

In FIG. 9, hinged fence post protector 100 is shown as having a shaped first flat piece 116 connected at one side to hinge 132. A second flat shaped piece 118 is also connected at one side to hinge 132. oppositely disposed from hinge 132 as a locking clasp 138 cable of cooperating with hinge 132 in order to secure fence post protector 100 around fence post 110. The outer perimeter of the fence post protector 100 as formed by shaped first flat piece 116 and second shaped flat piece 118 may be circular, square, rectangular, polygonal, irregular, or any other suitable shape.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A fence post protector being adapted to fit around a fence post comprising:

(a) a first substantially flat piece being connectable to a second substantially flat piece;

(b) an opening being formed between the first piece and the second piece;

(c) the opening being adapted to receive a fence post and fit closely therearound in order to substantially reduce growth of vegetation in ground around the fence post;

(d) at least one releasable fastener connecting the first substantially flat piece to the second substantially flat piece;

(e) the first substantially flat piece being nestable with the second substantially flat piece;

(f) the at least one releasable fastener being a first releasable fastener and a second releasable fastener connecting the first substantially flat piece to the second substantially flat piece;

(g) the first releasable fastener and the second releasable fastener being adapted to connect the first substantially flat piece to the second substantially flat piece with a fence post therebetween;

(h) the first substantially flat piece having a raised lip centrally located therein, (i) the raised lip being adjacent to the opening;

(j) the opening in the first substantially flat piece having a half fence post shape;

(k) the first substantially flat piece with the second substantially flat piece cooperating to surround the fence post;

(l) the first substantially flat piece having a lower flange at a first end thereof; and (m) the lower flange receiving a fastening flange.

2. The fence post protector of claim 1 further comprising:

(a) the fence post protector forming a tight seal around a base of the fence post;

(b) the fence post protector serving to deprive vegetation of sunlight, thereby preventing growth thereof;

(c) the fence post protector preventing an amount of moisture from settling around the base; and (d) the fence post protector having an outer perimeter with a generally elliptical shape.

3. The fence post protector of claim 1 further comprising:

(a) the fastening flange being oppositely disposed from the lower flange;

(b) the fastening flange on the first substantially flat piece receiving the lower flange on the second substantially flat piece; and (c) the fastening flange on the second substantially flat piece receiving the lower flange on the first substantially flat piece.

4. The fence post protector of claim 3 further comprising:

(a) a fastening means being adapted to secure the lower flange to the fastening flange;

(b) the first substantially flat piece having a main plane;

(c) the lower flange being parallel to the main plane; and (d) a plane lip situating between the lower flange and the main plane.

5. The fence post protector of claim 4 further comprising:

(a) the lower flange having a lip fastening aperture;

(b) the fastening flange having a flange fastening aperture;

(c) the lip fastening aperture on the first substantially flat piece being alignable with the flange fastening aperture on the second substantially flat piece; and (d) the lip fastening aperture on the second substantially flat piece being alignable with the flange fastening aperture on the first substantially flat piece.

6. The fence post protector of claim 5 further comprising:

(a) the fastening means being a threaded screw; and (b) the threaded fitting through the flange aperture into the lip aperture and then into the ground.

7. The fence post protector of claim 6 further comprising the outer perimeter being selected from the group consisting of circular, polygonal, elliptical, polygonal and irregular.

8. The fence post protector of claim 7 further comprising the outer perimeter being selected from the group consisting of square and rectangular.

9. The fence post protector of claim 6 further comprising the outer perimeter being elliptical.

10. The fence post protector of claim 1 further comprising:

(a) a hinge connecting the first substantially flat piece to the second substantially flat piece;

(b) the hinge being situated at one end of the fence post protector;

(c) the at least one releasable fastener being oppositely disposed from the hinge;

(d) the opening being situated between the hinge and the at least one releasable fastener; and (e) the hinge permitting movement of the first substantially flat piece relative to the second substantially flat piece.

11. The fence post protector of claim 10 further comprising:

(a) an elongated fastener cooperating with the fencepost protector to hold a proper position for the fence post protector relative to the fence post and the ground; and (b) the releasable fastener being a snap fastener.

12. The fence post protector of claim 11 further comprising:

(a) the opening having a raised sleeve therearound;

(b) the raised sleeve providing for extra protection against the vegetation growing around the fence post; and (c) the opening having a shape adapted to a circumference of the fence post.

13. The fence post protector of claim 11 further comprising:

(a) an elongated fastener cooperating with the fencepost protector in order to hold the fence protector in a desired position;

(b) the opening having a raised sleeve therearound;

(c) the raised sleeve providing for extra protection against the vegetation growing around the fence post; and (e) the hinge permitting movement of the first substantially flat piece in a substantially coplanar relationship to the second substantially flat piece.

14. A fence post protector being adapted to fit around a fence post comprising:

a first substantially flat piece being connectable to a second substantially flat piece;

an opening being formed between the first piece and the second piece;

the opening being adapted to receive a fence post and fit closely therearound in order to substantially reduce growth of vegetation in ground around the fence post;

at least one releasable fastener connecting the first substantially flat piece to the second substantially flat piece;

the fence post protector forming a tight seal around a base of the fence post;

the fence post protector serving to deprive vegetation of sunlight, thereby preventing growth thereof;

the fence post protector preventing an amount of moisture from settling around the base;

the fence post protector having an outer perimeter with a generally elliptical shape;

the first substantially flat piece being nestable with the second substantially flat piece;

the at least one releasable fastener being a first releasable fastener and a second releasable fastener connecting the first substantially flat piece to the second substantially flat piece;

the first releasable fastener and the second releasable fastener being adapted to connect the first substantially flat piece to the second substantially flat piece with a fence post therebetween;

the first substantially flat piece having a raised lip centrally located therein;

the raised lip being adjacent to the opening;

the opening in the first substantially flat piece having a half fence post shape;

the first substantially flat piece with the second substantially flat piece cooperating to surround the fence post;

the first substantially flat piece having a lower flange at a first end thereof;

the lower flange receiving a fastening flange;

the fastening flange being oppositely disposed from the lower flange;

the fastening flange on the first substantially flat piece receiving the lower flange on the second substantially flat piece;

the fastening flange on the second substantially flat piece receiving the lower flange on the first substantially flat piece;

a fastening means being adapted to secure the lower flange to the fastening flange;

the first substantially flat piece having a main plane;

the lower flange being parallel to the main plane;

a plane lip situating between the lower flange and the main plane;

the lower flange having a lip fastening aperture;

the fastening flange having a flange fastening aperture;

the lip fastening aperture on the first substantially flat piece being alignable with the flange fastening aperture on the second substantially flat piece;

the lip fastening aperture on the second substantially flat piece being alignable with the flange fastening aperture on the first substantially flat piece;

the fastening means being a threaded screw; and the threaded screw fitting through the flange aperture into the lip aperture and then into the ground.

15. A fence post protector being adapted to fit around a fence post comprising:

(a) a first substantially flat piece being connectable to a second substantially flat piece;

(b) an opening being formed between the first piece and the second piece;

(c) the opening being adapted to receive a fence post and fit closely therearound in order to substantially reduce growth of vegetation in ground around the fence post;

(d) at least one releasable fastener connecting the first substantially flat piece to the second substantially flat piece;

(e) the fence post protector being formed from an opaque plastic material;

(f) the fence post protector fitting around a base of the fence post;

(g) the fence post protector serving to deprive vegetation of sunlight, thereby preventing growth thereof;

(h) the fence post protector preventing an amount of moisture from settling around the base;

(i) the fence post protector having an outer perimeter with a generally elliptical shape;

(j) the first substantially flat piece being nestable with the second substantially flat piece;

(k) the at least one releasable fastener being a first releasable fastener and a second releasable fastener connecting the first substantially flat piece to the second substantially flat piece;

(l) the first releasable fastener and the second releasable fastener being adapted to connect the first substantially flat piece to the second substantially flat piece with a fence post therebetween;

(m) the first substantially flat piece having a raised lip centrally located therein;

(n) the raised lip being adjacent to the opening; and (o) the first substantially flat piece having an outer downward lip situated at an outer edge thereof.

16. A fence post protector being adapted to fit around a fence post comprising:

(a) a first substantially flat piece being connectable to a second substantially flat piece;

(b) an opening being formed between the first piece and the second piece;

(c) the opening being adapted to receive a fence post and fit closely therearound in order to substantially reduce growth of vegetation in ground around the fence post;

(d) at least one releasable fastener connecting the first substantially flat piece to the second substantially flat piece;

(e) the fence post protector being formed from an opaque plastic material;

(f) the fence post protector fitting around a base of the fence post;

(g) the fence post protector serving to deprive vegetation of sunlight, thereby preventing growth thereof;

(h) the fence post protector preventing an amount of moisture from settling around the base; and (i) the fence post protector having an outer perimeter with a generally elliptical shape.

17. The fence post protector of claim 16 further comprising:

(a) the first substantially flat piece being nestable with the second substantially flat piece;

(b) the at least one releasable fastener being a first releasable fastener and a second releasable fastener connecting the first substantially flat piece to the second substantially flat piece;

(c) the first releasable fastener and the second releasable fastener being adapted to connect the first substantially flat piece to the second substantially flat piece with a fence post therebetween;

(d) the first substantially flat piece having a raised lip centrally located therein;

(e) the raised lip being adjacent to the opening;

(f) the first substantially flat piece having an outer downward lip situated at an outer edge thereof.

18. The fence pose protector of claim 17 further comprising:

(a) the opening in the first substantially flat piece having a half fence post shape;

(b) the first substantially flat piece with the second substantially flat piece cooperating to surround the fence post;

(c) the first substantially flat piece having a lower flange at a first end thereof; and (d) the lower flange being adapted to receive a fastening flange, in order to form the fence post protector;

(n) the raised lip being adjacent to the opening; and (o) the first substantially flat piece having an outer downward lip situated at an outer edge thereof.

19. The fence post protector of claim 18 further comprising:

(a) the fastening flange being oppositely disposed from the lower flange;

(b) the fastening flange on the first substantially flat piece receiving the lower flange on the second substantially flat piece;

(c) the fastening flange on the second substantially flat piece receiving the lower flange on the first substantially flat piece;

(d) a fastening means being adapted to secure the lower flange to the fastening flange;

(e) the first substantially flat piece having a main plane;

(f) the lower flange being parallel to the main plane; and (g) a plans lip situating between the lower flange and the main plane.

20. The fence post protector of claim 19 further comprising;

(a) the lower flange having a lip fastening aperture;

(b) the fastening flange having a flange fastening aperture;

(c) the lip fastening aperture on the first substantially flat piece being alignable with the flange fastening aperture on the second substantially flat piece; and (d) the lip fastening aperture on the second substantially flat piece being alignable with the flange fastening aperture on the first substantially flat piece.

21. The fence post protector of claim 20 further comprising:

(a) the fastening means being a threaded screw;

(b) the threaded fitting through the flange aperture into the lip aperture and then into the ground; and (c) the fence post protector being formed from an opaque, ultraviolet stabilized, plastic material.

* * * * *